US010864388B2

(12) United States Patent
Tatarek

(10) Patent No.: US 10,864,388 B2
(45) Date of Patent: Dec. 15, 2020

(54) OXYGEN SYSTEM FOR PARACHUTING

(71) Applicant: C2M Design OCD Limited, Aldershot (GB)

(72) Inventor: Andrew Tatarek, Aldershot (GB)

(73) Assignee: C2M DESIGN OCD LIMITED, Aldershot (GB)

( * ) Notice: Subject to any disclaimer, the term of this patent is extended or adjusted under 35 U.S.C. 154(b) by 340 days.

(21) Appl. No.: 15/574,304

(22) PCT Filed: May 17, 2016

(86) PCT No.: PCT/GB2016/051422

§ 371 (c)(1),
(2) Date: Nov. 15, 2017

(87) PCT Pub. No.: WO2016/185201

PCT Pub. Date: Nov. 24, 2016

(65) Prior Publication Data

US 2018/0133523 A1 May 17, 2018

(30) Foreign Application Priority Data

May 18, 2015 (GB) ..... 1508529.3

(51) Int. Cl.
*A62B 9/02* (2006.01)
*A62B 7/14* (2006.01)
(Continued)

(52) U.S. Cl.
CPC ..... *A62B 9/027* (2013.01); *A62B 7/04* (2013.01); *A62B 7/14* (2013.01); *A62B 9/02* (2013.01); *A62B 18/025* (2013.01)

(58) Field of Classification Search
CPC ..... A62B 9/027; A62B 9/022; A62B 7/04; A62B 7/14; A62B 9/02
See application file for complete search history.

(56) References Cited

U.S. PATENT DOCUMENTS 2,685,288 A * 8/1954 Fields ..... A62B 7/14 128/204.26
4,148,311 A * 4/1979 London ..... A62B 7/14 128/204.26

(Continued)

FOREIGN PATENT DOCUMENTS

CN 103920219 A 7/2014
GB 2091562 A 8/1982

*Primary Examiner* — Samchuan C Yao
*Assistant Examiner* — Nathan M Le
(74) *Attorney, Agent, or Firm* — Carmody Torrance Sandak & Hennessey LLP

(57) ABSTRACT

An oxygen system supplies either 100% oxygen to a demand valve in a mask or pulses of oxygen to the mask. Switching is automatic during a parachute descent. The system includes a valve manifold that is responsive to ambient pressure such that at low pressures it is configured to deliver gas from either an oxygen cylinder or an aircraft supply line to the mask demand valve and at higher pressures it is configured to deliver gas from the cylinder to a pulse gas delivery system. The mask also includes an inhalation valve that is closed if oxygen is supplied to the demand valve. Otherwise, the inhalation valve opens to allow ambient air to be drawn in and the pulse gas delivery system delivers a pulse of oxygen in response to the onset of inhalation.

21 Claims, 9 Drawing Sheets

(51) Int. Cl.
*A62B 7/04* (2006.01)
*A62B 18/02* (2006.01)

(56) References Cited

U.S. PATENT DOCUMENTS

| | | | | | |
|---|---|---|---|---|---|
| 4,250,876 | A * | 2/1981 | Kranz | A62B 9/027 | 128/202.22 |
| 4,335,735 | A * | 6/1982 | Cramer | A62B 9/022 | 128/204.26 |
| 4,336,590 | A * | 6/1982 | Jacq | B64D 10/00 | 128/204.21 |
| 4,404,969 | A | 9/1983 | Cresswell et al. | | |
| 4,450,852 | A | 5/1984 | Gregory | | |
| 4,651,728 | A * | 3/1987 | Gupta | A62B 7/14 | 128/201.28 |
| 4,898,174 | A * | 2/1990 | Fangrow, Jr. | A61M 16/00 | 128/204.24 |
| 5,411,059 | A * | 5/1995 | Sever | F17C 13/04 | 128/205.24 |
| 5,540,218 | A | 7/1996 | Jones et al. | | |
| 2003/0010341 | A1* | 1/2003 | Martinez | A62B 7/14 | 128/204.26 |
| 2008/0173355 | A1* | 7/2008 | Meckes | B64D 10/00 | 137/109 |
| 2010/0300444 | A1* | 12/2010 | Decker | A61M 16/024 | 128/204.23 |
| 2013/0312744 | A1* | 11/2013 | Kshirsagar | B64D 11/00 | 128/202.26 |

* cited by examiner

OXYGEN SYSTEM FOR PARACHUTING

CROSS REFERENCE TO RELATED APPLICATIONS

This application is a National Stage of International Application No. PCT/GB2016/051422, filed May 17, 2016, the subject matter of which is herein incorporated by reference in its entirety.

BACKGROUND

The present invention relates to the field of high-altitude parachuting and, specifically, to a system to supply oxygen to a parachutist that is adaptable for use both before and during descent.

High-altitude parachuting carries risks additional to those that are immediately apparent when jumping out of a plane at lower altitudes. It is not uncommon for parachutists to exit an aircraft at altitudes above 15,000 and often up to 35,000 feet. The timing at which a parachutist chooses to deploy the parachute depends on circumstances: it can be relatively soon after exiting the aircraft or it can be far later during the descent, perhaps at an altitude of around 5,000 feet. In both cases however, the parachutist is required to be sufficiently alert to act.

As is well-known, atmospheric pressure reduces with altitude and so less oxygen is available for consumption. At altitudes above 22,000 feet (6,700 m), the partial pressure of oxygen in the Earth's atmosphere is, in most cases, too low to support consciousness. Even below this level, the reduction in oxygen can lead to hypoxia as insufficient oxygen reaches the body tissues.

The symptoms of hypoxia are varied, for example: fatigue, light-headedness, nausea, disorientation, confusion, euphoria and potentially loss of consciousness. A jumper losing consciousness will clearly be unable to deploy a parachute but, even with lesser symptoms, life-threatening situations can be brought about by the effect hypoxia has on the parachutist's ability to make properly rational decisions. In addition, vision may be affected, which reduces the ability to spot potential hazards.

For this reason alone high-altitude parachutists carry their own source of oxygen. This is usually a cylinder with a regulator and valve arrangement to supply pressure to a demand valve, connected to a mask sealed to the users face. In certain situations, for example, a military exercise, the parachutist is required to carry a significant amount of equipment for use on landing. It is accordingly desirable to keep the oxygen cylinder that they must also carry as small as possible. This leads to a requirement for efficient oxygen delivery.

Another significant risk to the high-altitude parachutist is decompression sickness. This occurs as a result of a large drop in environmental pressure. This is a danger for deep-sea divers coming to the surface, as is well known, but also for parachutists following, for example, a rapid ascent in the jump aircraft or depressurisation of the aircraft cabin in preparation for a jump. As a result of such sudden decompression, nitrogen within the body can come out of solution and form bubbles in the tissues and blood stream. Symptoms include joint pain from bubbles forming near joints, but also more severe complications such as paralysis, breathing problems and unconsciousness. Untreated decompression sickness can lead to permanent disability and even death.

In order to prevent decompression sickness, nitrogen should be flushed from the bloodstream prior to the reduction in atmospheric pressure. This is typically achieved by "pre-breathing" 100% oxygen for a period of 30-45 minutes before cabin depressurisation and the jump.

This second risk provides an additional need for a parachutist to have access to a supplementary supply of oxygen.

Typically, the parachutist will make use of a bailout system. This includes the oxygen cylinder, mask and valve arrangement noted previously. Whilst the aircraft cabin is still pressurised, the bailout system is donned by the parachutist and connected to the aircraft oxygen supply for the pre-breathing phase. As there is no requirement for the parachutist to be mobile at this point, and it is advantageous to minimise the size, and therefore oxygen content, of the cylinder, pre-breathing is carried out using, so far as possible, the aircraft oxygen supply and not that of the bailout cylinder. Pre-breathing can continue while the aircraft cabin is depressurised and the cabin door opened in preparation for jumping.

When the user is about to jump, the aircraft supply is disconnected and breathing continues from the bailout cylinder oxygen supply.

During the descent, ambient pressure and air oxygen content increase. Whilst the parachutist will therefore need to be provided with a 100% oxygen breathing gas at altitudes above around 20,000 feet, the requirement for supplemental oxygen diminishes during the course of the jump. With the desire to lighten the load carried by the parachutist therefore, it is desirable to avoid over-consumption of cylinder oxygen by reducing the percentage supplied to the parachutist. This is achieved in the prior art by use of a diluter demand valve.

An example of a diluter demand valve is described in, for example, Intertechnique U.S. Pat. No. 6,994,086 (B1). Oxygen is supplied to a user but the demand valve also includes an air intake, which is opened and closed by an aneroid. An aneroid is an evacuated metal bellows arrangement that therefore expands as the pressure around it decreases. The shortening of an aneroid during a descent can be used to adjust the degree of opening of the air intake, thus increasing the amount of oxygen drawn from the environment and reducing that drawn from the cylinder. The intake is closed above a threshold altitude.

The arrangement means that the user is supplied with a gas mixture that gradually increases the air percentage that dilutes the oxygen as the parachutist falls. Overall therefore, less oxygen is consumed.

Problems with the Prior Art

Known diluter demand valves that are used to give oxygen below the threshold at which 100% oxygen is needed do not provide an efficient mechanism for oxygen delivery. Broadly speaking, the timing of oxygen delivery is a long way from being optimised with respect to the respiration cycle. Oxygen is delivered throughout the inhalation phase, whereas only about the first ⅓ finds its way to the alveoli for absorption. The oxygen delivered during the later part of the inhalation phase ends up in the mask dead-space and airways from which it is exhaled, without being absorbed. To compound this, at the very initial stage of inhalation, gas is first drawn from the mask and this is the gas that has just been exhaled. That is, at the onset of inhalation, oxygen-depleted gas is drawn from the mask before it is replaced with oxygen from the demand valve, which is then inhaled for the remainder of the inhalation phase.

Aneroids with a consistent movement characteristic are difficult and expensive to make. It is relatively straightforward to make an aneroid that will open or close a valve at a given pressure. It is however difficult to do so when a repeatable variation of length with altitude is needed. For repeatable operation, the diluter demand valve requires an aneroid with a consistent expansion and contraction rate, in order to ensure that the oxygen input varies properly with altitude. This can be difficult to achieve, as there are a number of factors during bellows manufacture in which the dimensions, e.g. material thickness, bellows convolution width, have a cubed effect on the rate, making manufacture on the limits of what is possible.

Moreover, aneroids are delicate devices and, at a size that is feasible for incorporation in a diluter demand valve, offer little force. If one is relied on to close the air intake, there is a risk of it not closing properly. Consequently, if the mask is used during the pre-breathing phase, there is a possibility of air being drawn in through the intake. This introduces nitrogen to the inhaled gas, which then risks decompression sickness.

In addition to mask leakage through the inhalation valve, prior art systems are also susceptible to admit nitrogen during the changeover from the pre-breathing phase to reliance on the oxygen cylinder, particularly if problems are encountered attaching the cylinder. Even a single breath of air at a higher pressure (lower altitude) may elevate the jumper's arterial nitrogen to a level that can cause decompression sickness at a lower pressure.

Automation is desirable as this removes the responsibility of decision regarding the oxygen system from the parachutist. This leaves him free to concentrate on the job in hand and reduces the likelihood of mistakes. Prior art bailout systems have variable amounts of user input required. For example, when pre-breathing in a pressurised cabin, it is necessary to switch to a 100% mode, in which the diluted air path is closed. If there are actions to remember, there is the chance of forgetting, which can give rise to subsequent problems.

It is known that a pulsed oxygen delivery system is much more efficient at getting oxygen to the alveoli than a diluter demand valve. A pulsed delivery system detects the onset of inhalation and immediately delivers a pulse of oxygen, which ensures that it is included with the first gas inhaled. Oxygen inhaled early in the respiration cycle is far more likely to end up in the alveoli. Furthermore, as the pulse is short, there is no oxygen delivered with the gas that ends up in the airways and mask dead-space. Typically about three to five times as much oxygen is required in a continuous delivery system to achieve the same oxygen delivery into the lungs.

Despite the drawbacks of the prior art, the diluter valve bailout system is commonly used. There is a perceived need for an alternative design of oxygen delivery system that is capable of delivering oxygen to the lungs with increased efficiency than known in the prior art.

The Present Invention

The present invention provides a supplementary oxygen system or bailout system that can be used in activities such as parachuting. The bailout system of this invention delivers 100% oxygen from a demand valve at altitudes above a set threshold, and pulsed oxygen at altitudes below the threshold.

More specifically, the present invention provides a supplementary oxygen system for variable-altitude use, the system comprising:

a valve manifold that is connectable via a regulator to a pressure vessel containing compressed oxygen, the valve manifold having first and second outputs and an output selection valve;

a pulse gas delivery system in fluid communication with the second output and that is activatable to deliver a pulse of gas of predetermined duration; wherein the output selection valve is switchable between a first position in which gas flowing through the manifold is directed to the first output and a second position in which gas flowing through the manifold is directed to the second output and to the pulse gas delivery system.

On the face of it, it would appear that a pulsed delivery system and demand valve have requirements that render them mutually exclusive. The demand valve requires operation with a closed mask to ensure only the 100% oxygen that flows through it is delivered to the lungs. On the other hand, a conserving device based on a pulsed delivery system requires an intake in the mask that is able to pass air from the environment to a user, this air being only supplemented by the pulse of oxygen delivered at the start of inhalation. It is accordingly not readily apparent how a demand valve and pulse system could be integrated.

In another aspect therefore, this invention provides a mask for use with a bailout system. The mask includes a demand valve that is connectable to the first output of the valve manifold of the bailout system; an inhalation valve; a connection manifold that is connectable with an output of the pulse gas delivery system; an exhalation valve; and a sensing line that provides fluid communication between the inhalation valve and an input to the demand valve. The inhalation valve is configured such that it is closed if a gas pressure above ambient is present in the sensing line i.e. if the demand valve is needed to supply 100% oxygen. Otherwise, it is openable to allow ambient air to be drawn into the mask. The pulse gas delivery system is configured to be responsive to a drop in pressure inside the mask to deliver a pulse of oxygen.

The bailout system can donned when the aircraft cabin is still pressurised and connected to the aircraft oxygen supply. This automatically selects '100% Oxygen' mode, regardless of cabin pressure. This allows pre-breathing on 100% oxygen from the console supply without draining the bailout system oxygen supply. Pre-breathing can therefore continue while the aircraft cabin is de-pressurised.

If the aircraft supply pressure is running out and the pressure drops too low for operation, the system will switch to using oxygen from the bailout cylinder, so breathing is uninterrupted.

The system allows the user to disconnect from the aircraft supply.

If the ambient pressure is below the mode switching threshold (around 20,000 ft, but can be set to any altitude, in accordance with medical advice), the system would keep the supply to the '100% Oxygen' demand valve, so the user will keep breathing 100% oxygen, both when in the aircraft and after jumping.

As the parachutist descends and the pressure rises above the threshold for which 100% oxygen is required, a system in accordance with this invention will switch automatically to 'Pulse Dose' mode, and will continue in this mode until the parachutist lands.

The system is capable of significantly improved oxygen delivery in comparison with the prior art. This means that the same size cylinder can provide oxygen for longer, which may be particularly useful if the parachute is deployed early in the descent. Alternatively, a smaller cylinder may be used, reducing the burden on the parachutist. Moreover, this system, with no reliance on aneroid control of the degree of valve opening, is easier to manufacture. It is also capable of providing fully automatic operation, so that there are as few decisions to be made in the operation of the system as is possible.

The invention will now be described, by way of example only, and with reference to the accompanying drawings, in which.

DESCRIPTION OF PREFERRED EMBODIMENTS

FIG. 1

Figure 1:
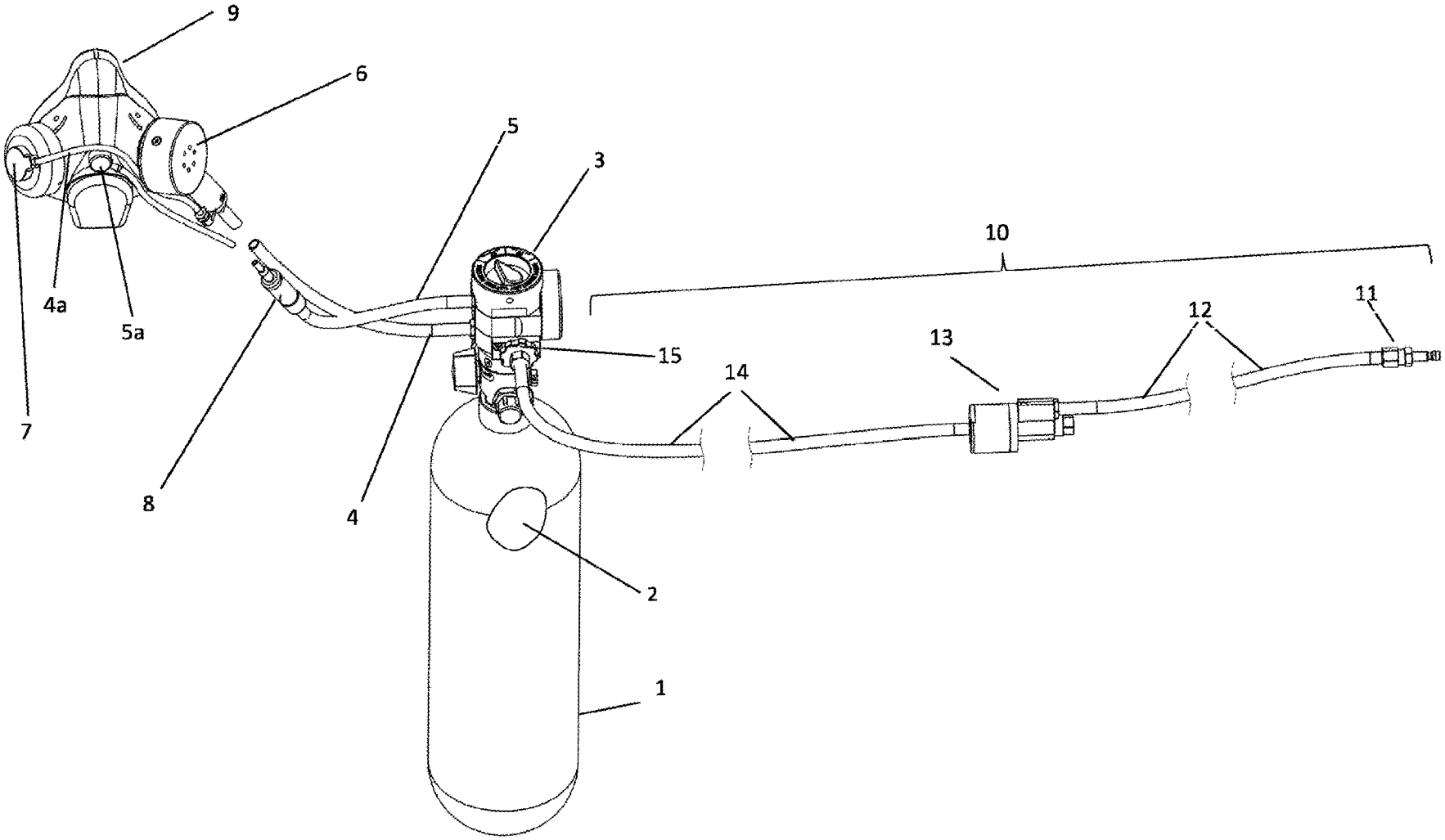
FIG. 1 shows a possible embodiment of the present invention, integrated into a complete bailout system, including the hose to deliver the oxygen from the aircraft oxygen supply.

With reference to FIG. 1, there is shown an overview of a complete bailout system that includes aspects of the present invention. Also shown in the overview is the hose to deliver oxygen from the aircraft oxygen supply that is detached at the bailout cylinder end before exiting the aircraft.

A cylinder (or other pressure vessel) (1) containing oxygen at high pressure (2) is connected to a bailout manifold valve (3). The detail of the manifold valve is shown in FIGS. 2 and 3 and its operation will be explained in more detail later, with reference to these figures.

The manifold valve has two outlets. The first is a supply (4) to a demand valve (6). The demand valve uses known technology to deliver 100% oxygen in response to a user's demand. The second supply (5) is to a connection (5*a*) on a mask (9). This outlet is used to deliver pulsed oxygen in response to a user's inhalation. A flow indicator (8) may be incorporated in the second supply line (5) to give a visual indication of pulsed flow.

The supply to the demand valve is also fed to an inhalation valve (7) via a tube (4*a*). The inhalation valve is closed when pressure to the demand valve (6) is present, thus ensuring that all inhalation is from the demand valve. When there is no pressure to the demand valve (6), the inhalation valve is open, allowing the user to inhale though a valve with a small opening pressure. The pressure required to open the inhalation valve is relatively small, but still set to be higher than that needed to activate a pulsed delivery system in the bailout manifold valve (3). This timing of oxygen delivery ensures that oxygen is included at the start of the inhalation gas intake. That is, the user will first inhale the pulsed oxygen and then the remainder of their inhalation breath will be formed from ambient air drawn through the inhalation valve.

An oxygen supply hose (10) includes a connector (11), which is used to connect to the aircraft oxygen supply, typically at 5 bar, two lengths (12, 14) of hose and a pressure shut-off valve and regulator (13). The hose (12) extends between the connector (11) and the input of the minimum pressure shut-off valve and regulator (13). This device (13) reduces the input pressure in the supply hose (14) to the working pressure of the bailout manifold valve (3), which is lower than the normal output pressure of the aircraft oxygen supply. If the pressure of the aircraft oxygen supply falls below a threshold, typically just below the level of the working pressure of the bailout manifold, the minimum pressure shut-off (13) activates and shuts.

The output of the minimum pressure shut-off valve and regulator (13) feeds through a hose (14) to a connector (15), which connects into a port in the bailout manifold valve (3). Fitting the connector (15) to the bailout manifold valve mechanically switches the output to be 100% oxygen through the demand valve and supplies the system with oxygen from the aircraft supply.

If the aircraft oxygen supply fails, but connector (15) is still connected to the bailout manifold valve (3), a valve in the bailout manifold valve switches, so that the user inhales from the bailout cylinder (1), without interruption to their breathing.

When the connector (15) is disconnected from the bailout manifold valve (3), the valve becomes responsive to ambient air pressure. A valve within the bailout manifold valve determines either 100% oxygen delivery or pulsed oxygen delivery, each delivered from the bailout cylinder. The valve switches automatically between these two states, as dictated by ambient pressure.

Figures 2A, 2B, 2C:
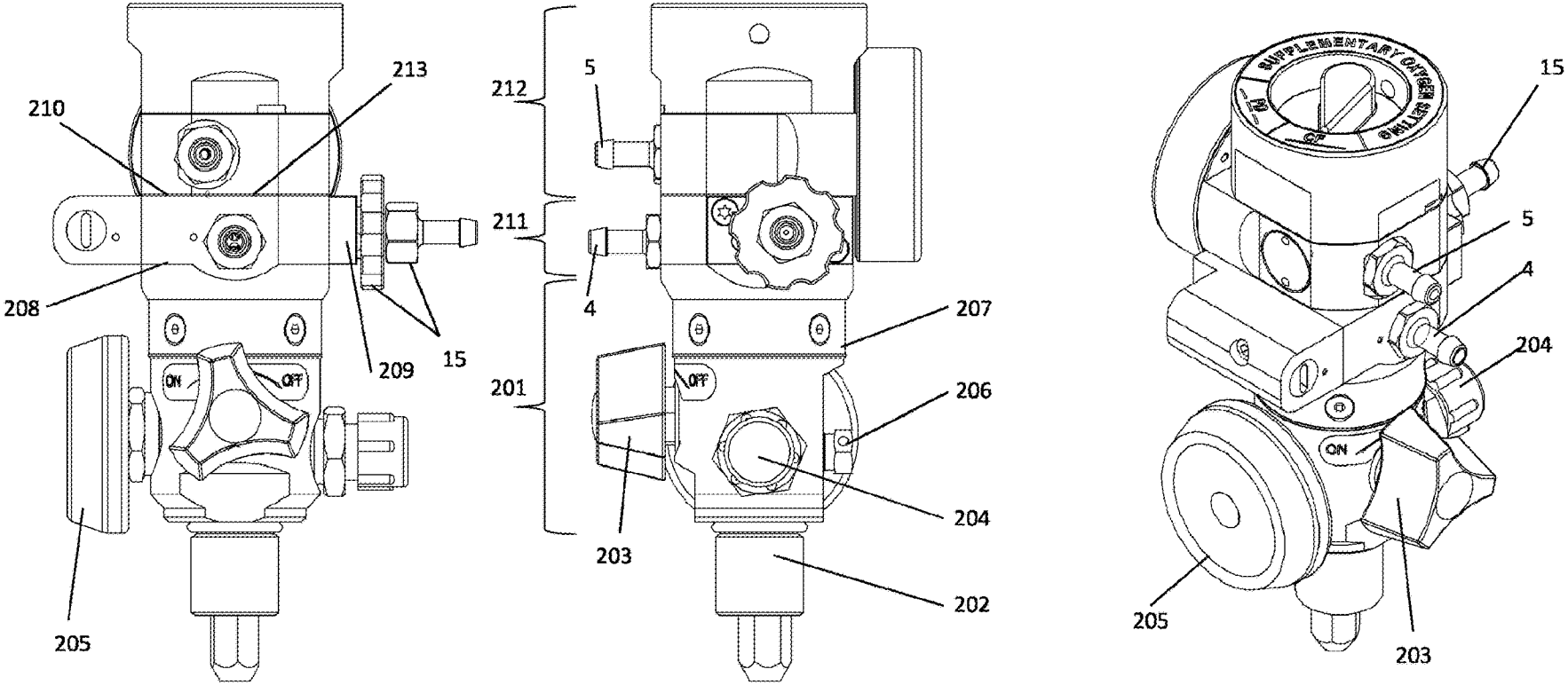
FIG. 2A to 2C show different views of a possible embodiment of the present invention, illustrating a bailout valve manifold, with its different functions.

FIGS. 2A to 2C

These FIGS. 2A to 2C illustrate, from different angles, a bailout valve manifold in accordance with an embodiment of the present invention. The bailout valve manifold consists of three main components.

High Pressure Valve and Regulator, (201)

The high pressure valve and regulator (201) delivers low pressure (typically 4 bar) oxygen to the parts downstream. It consists of a threaded connection (202) to the cylinder (1), with an on-off valve (203) a fill connection (204), a pressure indicator (205), burst disc, (206) and a regulator (207). These elements are well known to one skilled in the art, so will not be described in detail. The on-off valve may be omitted or replaced with a valve on the low pressure side, after the regulator.

Input and Output Mode Selection Manifold (211)

This is described in more detail with reference to FIG. 3, but an overview of its function is as follows:

The manifold (211) includes an arrangement of valves and passages. The configuration of the valves determines which particular passages are brought in to form a fluid connection between one of two inputs: one from the regulator (201) via interface (208) and a second being an oxygen input (209)

from the aircraft oxygen supply; and one of two outputs: a first being an input (213) of the oxygen pulse delivery system via interface (210) and the second being the outlet (4) to the demand valve.

The oxygen input (209) receives the connector (15) from the aircraft oxygen supply. The connector mechanically activates a valve (shown in FIG. 3A) within the manifold to select delivery to the demand valve outlet connection (4), and to close the output to the pulsed delivery unit (212).

The detail of the input and output mode selection manifold can be more clearly understood with reference to FIG. 3.

Oxygen Pulse Delivery Unit (212)

Examples of pulse delivery units are known in the prior art. In this embodiment, the unit (212) receives oxygen from the input and output selection manifold, as determined by various components within the manifold (211). The unit delivers a pre-determined pulse of oxygen to a user immediately in response to a drop in pressure, at the onset of the user's inhalation. Such devices are, for example, described in EP1863555, "Conserving device for breathable gas".

FIGS. 3A to 3D

FIGS. 3A to 3D show schematic sections of an embodiment of an input and output mode selection manifold (211) that selects the oxygen source and delivery mode. The views put into one plane all the working elements to enable them to be seen together, to aid understanding.

Figure 3A:
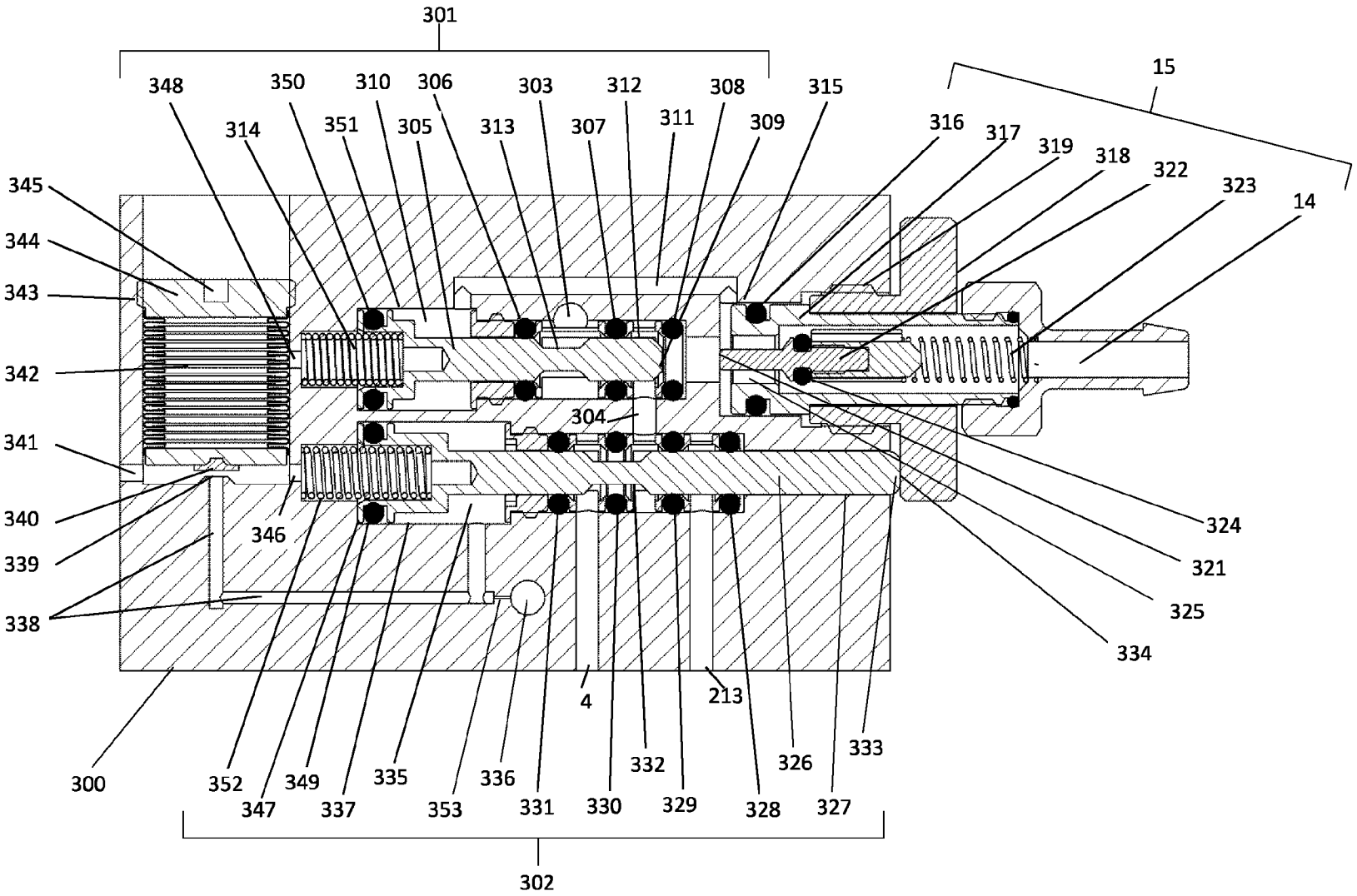
FIGS. 3A to 3D show a possible embodiment of an input and output mode selection manifold that selects the oxygen source and delivery mode.

The function of the input and output selection manifold in all operating states, is shown in the progression of FIG. 3A through to 3D.

FIG. 3A shows the input and output selection valves in the position they are in when the aircraft oxygen supply is connected, regardless of the ambient pressure. This is as would be seen in a pressurised, or depressurised, cabin for pre-breathing on 100% oxygen from the aircraft oxygen supply.

Figure 3B:
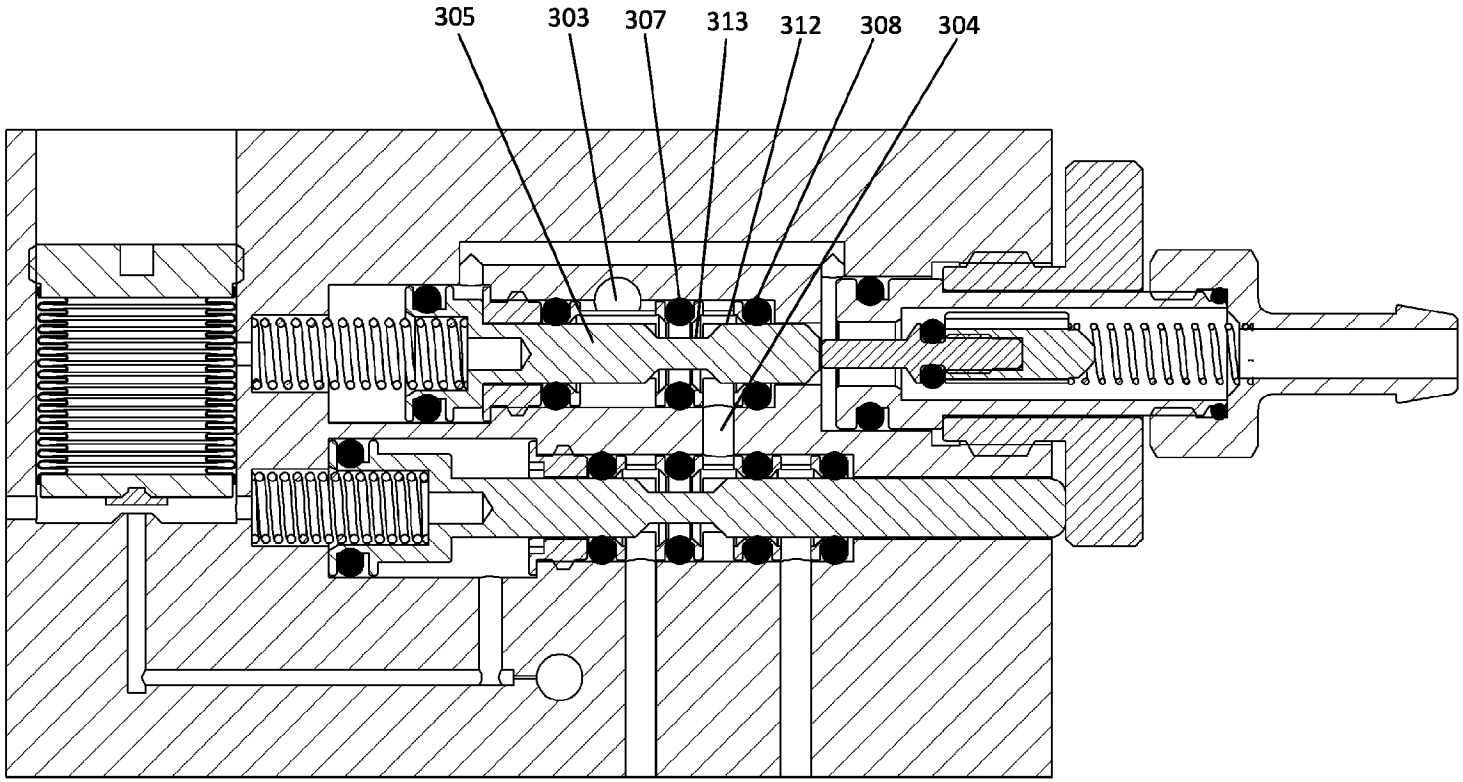

FIG. 3B shows the input and output selection valves in the position they are in when the aircraft oxygen supply is connected, regardless of the ambient pressure, but the supply of oxygen is insufficient. This is as would be seen when the aircraft oxygen supply has failed, so the pressure at the connector (15) is zero.

Figure 3C:
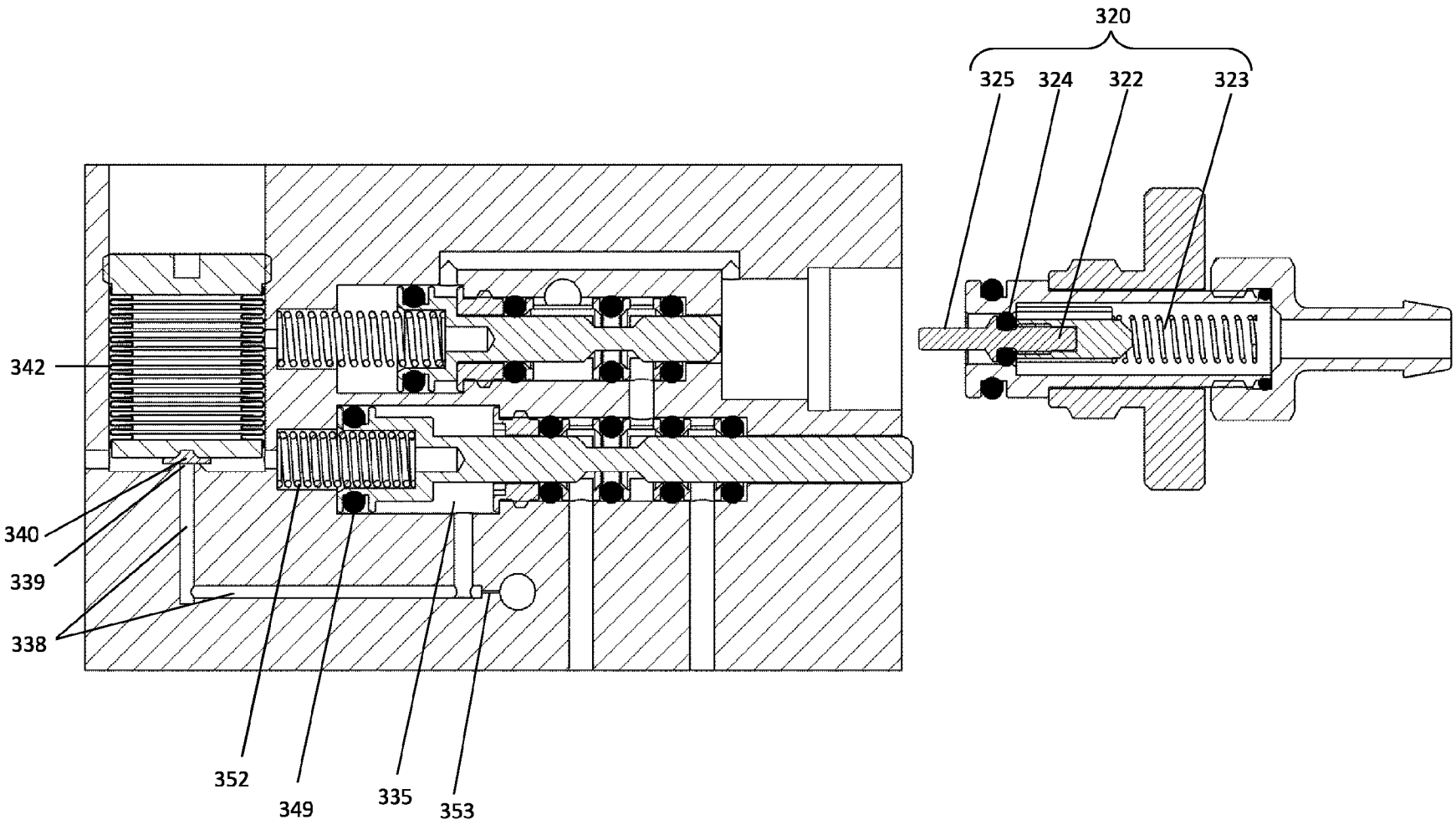

FIG. 3C shows the input and output selection valves in the position they are in when the aircraft oxygen supply is disconnected, and the altitude is higher than the threshold for 100% oxygen.

Figure 3D:
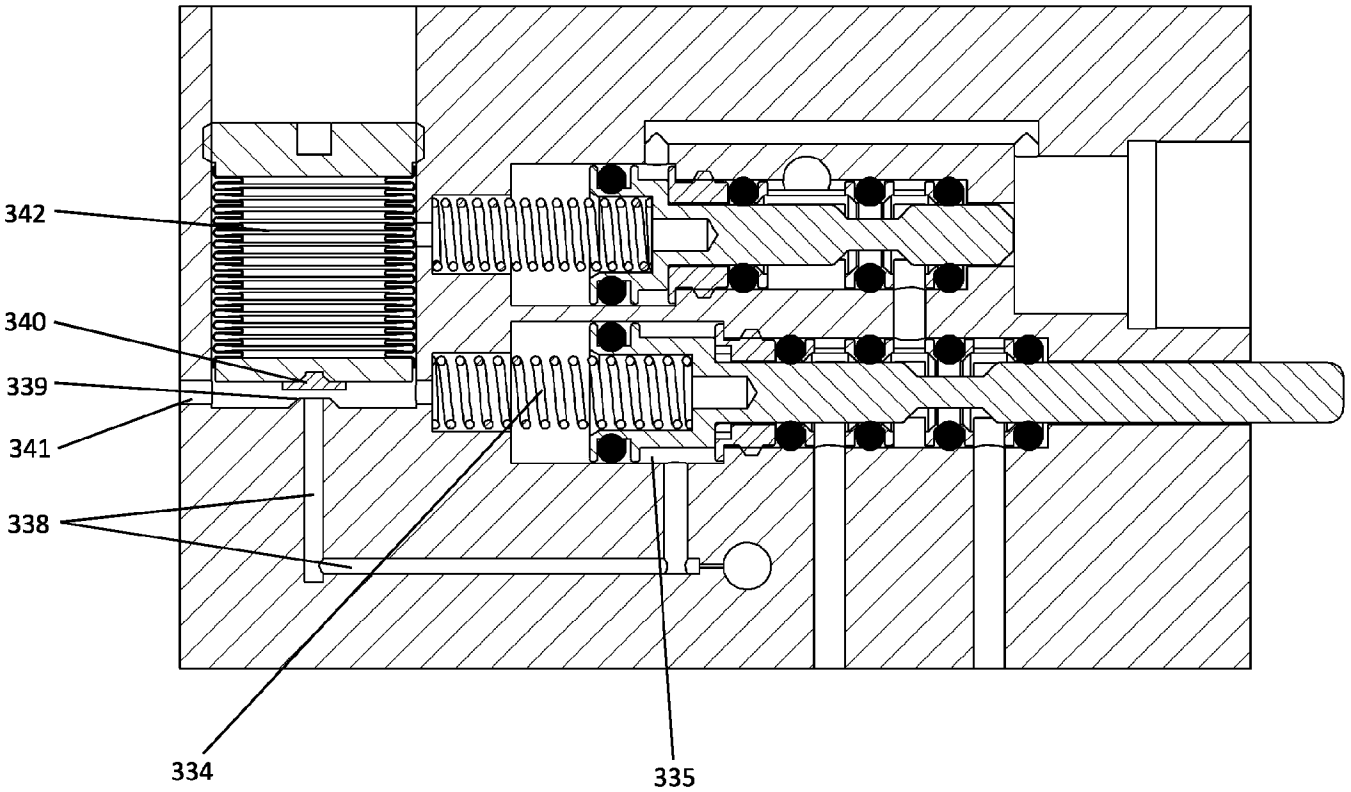
Figure 4:
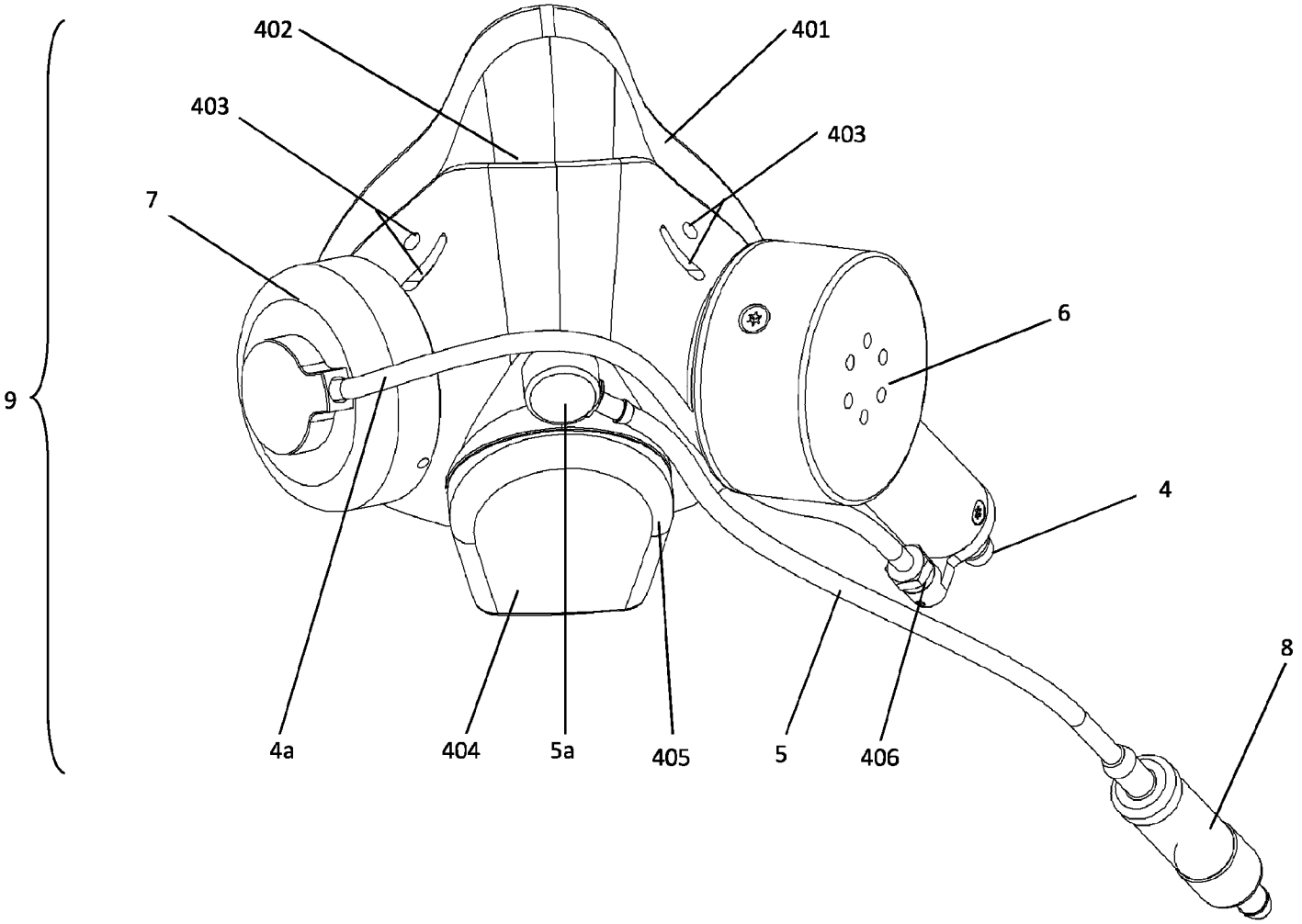
FIG. 4 shows a possible embodiment of a mask according to the present invention, with its parts.

FIG. 3D shows the input and output selection valves in the position they are in when the aircraft oxygen supply is disconnected, and the altitude is lower than the threshold for 100% oxygen.

With reference first to FIG. 3A, a housing (300), contains three main elements that make up the input and output mode selection manifold.

Aircraft Oxygen Supply Connection (15)

The Aircraft oxygen supply connection (15) is connected to a port (315) in the housing (300). A seal (316) on a connector (317) seals against the side of the port (315). The connector (317) is held in the port by a hand-wheel (318) retained by a thread (319). The connector (15) and its parts can be seen more clearly in FIG. 3C. A check valve (320) in the connection includes a poppet (322) with end (321) and seal (324) that is biased towards a closed position by a spring (323). As the connection is made, contact between the end (321) of the poppet (322) and some part of the housing (300), moves the seal (324) against the bias of the spring (323) and out of sealing contact with a bore (325).

When the aircraft oxygen supply connection is disconnected from the connection (315), as shown in FIG. 3C, the spring urges the poppet (322) to a closed position in which the seal (324) is in sealing contact with the bore (325). This means that there is no flow from the aircraft oxygen supply connection, unless it is connected to the bailout system.

Input Selection Valve (301)

The input selection valve directs oxygen to a passage (304). The oxygen enters the input selection valve (301) either from a port (303) in connection with the regulator (207) (hence from the bailout cylinder) or from a connector (15) of the aircraft oxygen supply hose (14) The passage (304) connects to the input of the output selection valve (302).

If the aircraft oxygen supply is connected and pressure is present, the aircraft oxygen supply is selected. If the aircraft oxygen supply fails, or is not connected, the passage (304) is connected via port (303) to the regulator output (207).

A pressure supply spool piston (305) runs in spool seals (306), (307), (308). The piston includes an end (309) located at the aircraft oxygen supply connection port (315) and a sliding piston head seal (350) running in a bore (351) that defines a chamber (310) in the housing (300). If aircraft oxygen supply pressure is present, it acts on the end (309) of the piston and also builds up in the chamber (310). Pressure in this chamber (310) acts on the sliding piston head seal (350), in a direction that reinforces the effect of pressure at the end (309). The bias supplied by the spring (314) counters this effect of aircraft supply pressure. The net result of the forces on the piston (305) is that it can be biased into either of two positions. The aircraft oxygen supply pressure is communicated to the chamber (310), via a passage (311). A vent to atmosphere (348) ensures that there is no trapped pressure on the spring side (314) of the supply spool piston and so is free to move.

The spring and piston sizes are arranged such that when the aircraft oxygen supply is at a normal level, pressure biases the piston to be in the position shown in FIG. 3A, so the large diameter of the spool (312) is clear of the o-ring (308), so oxygen is free to flow from the connection (15) to the passage (304).

When the aircraft oxygen supply level fails and drops to zero, or the connector (15) is disconnected, the spring biases the spool piston (305) to be in the second position seen in FIG. 3B. The large spool diameter (312) slides into sealing contact inside the seal (308), blocking off the connection between the aircraft oxygen supply and the passage (304). The small diameter (313) of the spool (305) is in line with o-ring (307), opening the path between supply (303) and the passage (304) so the passage (304) is supplied with oxygen from the bailout cylinder via the regulator (207).

Output Selection Valve (302)

The output selection valve supplies oxygen from the passage (304) to:

(A) Output (4) to feed the demand valve (6 in FIG. 1) if the aircraft oxygen supply (15) is connected or if the ambient pressure is below the threshold for 100% oxygen delivery; or (B) The output (213) (also see FIG. 2A) to supply the pulse delivery unit (212 in FIG. 2B) if the aircraft oxygen supply is disconnected and the ambient pressure is above the threshold for 100% oxygen delivery.

FIG. 3A shows one embodiment of output selection valve that is configured to state (A). An output selection spool piston (326) runs in a bore in the housing (300) and is arranged to be moveable between two positions. In a first position, as shown in FIG. 3A, the large spool diameter (327) is in sealing contact with o-rings (328), (329), and (331), and the small spool diameter (332) is in line with the o-ring (330), allowing gas to flow from passage 304 to the outlet (4) to feed the demand valve for 100% oxygen.

In FIGS. 3A and 3B, the piston is held in this position by a face (333) of the piston (326) being pushed by a face (334) of the hand wheel (318) of the connector (15). This prevents the piston being moved by a spring (352), which is arranged to apply a bias towards the piston position in which gas output (213) is to the pulsed delivery system (212). Whatever the ambient pressure, therefore, the gas supply is to the demand valve feed (4).

When the connector 15 is removed and the ambient pressure is lower than the threshold for 100% oxygen, and so supply to the demand valve needs to be maintained, it is necessary that the piston is kept in this position, even though the hand-wheel (318) is not there to push it.

This alternative mechanism to maintain position (A) is achieved by a pressure building up in the chamber (335), which acts on a seal (349) on the head (347) of the piston, sliding in a bore (337). When pressure at the output pressure of the regulator (207) is present in chamber (335), the piston (347) is held in the position shown in FIGS. 3A to 3C.

Position (B) is achieved as follows: When pressure is not present in the chamber (335), the spring (352) moves the piston to the second position, as shown in FIG. 3D. In this state, the position of the small diameter (332) of the spool is in line with o-ring (329), allowing a connection from the passage (304) to the feed (213) to the pulse delivery unit (212) (not shown).

A vent to atmosphere (346) ensures that there is no trapped pressure on the spring side (347) of the output selection spool piston (326) and so the spool piston is free to move.

The pressure in chamber (335) is controlled as follows:

Gas from a connection from the regulator (207, not shown) communicates with a port (336). The pressure acts to push gas through a bleed restrictor (353) into a passage (338). The restrictor is set to give a low flow, arranged to be small in the context of the cylinder and expected duration e.g. in the region 10 ml/min.

Passage (338) communicates with a seat (339), which can be sealed or open according to the position of a seal (340) under the action of an aneroid (342).

In FIG. 3A, the ambient pressure is above the threshold set for 100% oxygen. The higher pressure means that the aneroid (342) is compressed, with the result that the seal (340) is out of contact with the seat (339). The bleed flow from the restrictor (353) into the passage (338) is therefore free to flow from the seat (330) and out of a vent (341) to ambient. The seat is arranged to be as small as possible, to minimise seat pressure force on the aneroid, but large compared the bleed restrictor (353). There is therefore no pressure build-up in the passage (338) or the chamber (335), so the spool piston (357) is free to be moved by the spring (334) if the connector (15) is disconnected, or by the connector hand wheel face (334) acting against the spring when the connector is connected.

The situation shown in FIG. 3C arises when the parachutist is at high altitude, where the pressure is below the threshold and 100% oxygen is required. The aneroid (342) is expanded, and the seal (340) sealably held against the seat (339). Flow from the bleed restrictor (353) cannot escape, and so the pressure in the passage (338) and chamber (335) builds up until it is equal to the supply pressure. This pressure, acting on the area of the seal (349), pushes the piston against the spring (352) to the position shown in FIG. 3C, so the user is breathing 100% oxygen.

As the parachutist falls and the pressure around him increases, the aneroid (342) compresses in response to the ambient pressure increase. As the pressure increases above the threshold for 100% oxygen, the seal (340) moves away from the seat (339), and breaks the seal. The pressure in the chamber (335) and the passage (338) escapes, and exits through the vent (339), and the spring (334) urges the piston to position (A), as seen in FIG. 3D.

In FIG. 3C, the connector (15) is shown in its configuration when disconnected from the manifold. The spring (323) urges the poppet (322) into a sealing position, where the seal (324) seals the bore (334). This prevents the escape of gas from the supply hose (10 in FIG. 1).

The aneroid (342) can be adjusted by the thread (343) of an adjusting screw (344), which is advantageously connected to the aneroid. The screw can be set such that the aneroid opens at a given pressure by holding it at the threshold pressure, monitoring the pressure in chamber (335), and adjusting the thread using a screwdriver in the slot (345). The setting can be checked by changing the pressure around the parts, and noting the pressure around the aneroid at which the pressure in chamber (335) collapses. The thread (343) can be locked by use of a suitable sealant.

FIG. 4

This figure shows an embodiment of a mask assembly according to an aspect of the present invention, with its parts. Most are known so will not be described in detail, and, where necessary, additional detail is shown in subsequent figures.

A face-seal (401) made of a resilient material such as rubber is shaped to seal against the face of a user. A hard shell or exoskeleton (402) may be used on the outside of the rubber with a number of fastening features (403), which are used to attach a harness or similar to hold the mask to the face.

The mask and harness may be available in a number of sizes to seal to the faces of a variety of users.

The supply (4) to the demand valve (6) supplies oxygen according to the input and output selection manifold (211). The demand valve may be any of a number of types, able to provide oxygen to the user to meet their demand, for example that described in EP14168160.1 "Medical breathing apparatus". It may be advantageous for the demand valve to provide a slightly positive pressure—i.e. slightly above atmospheric pressure so that if there are any leaks, they are out, and not in. Achieving positive pressure with a demand valve is known.

Figure 5B:
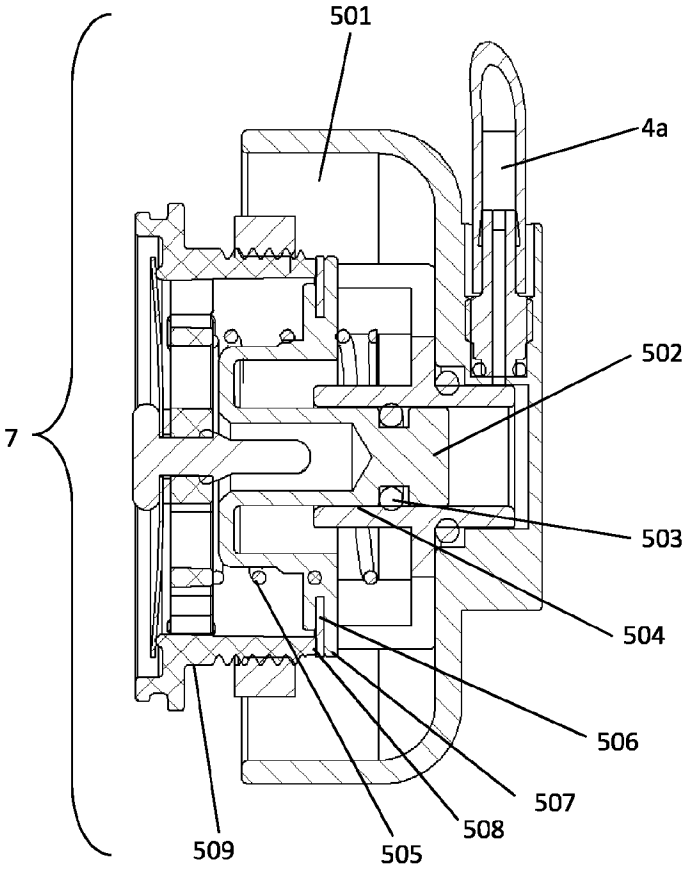
FIGS. 5A and 5B show a possible embodiment of an anti-suffocation valve according to the present invention, which is open when pressure to the demand valve is not present (as shown in FIG. 5A), allowing the user to inhale through an inhalation valve, and closed (as shown in FIG. 5B) when the pressure to the demand valve supply is present.
Figure 5A:
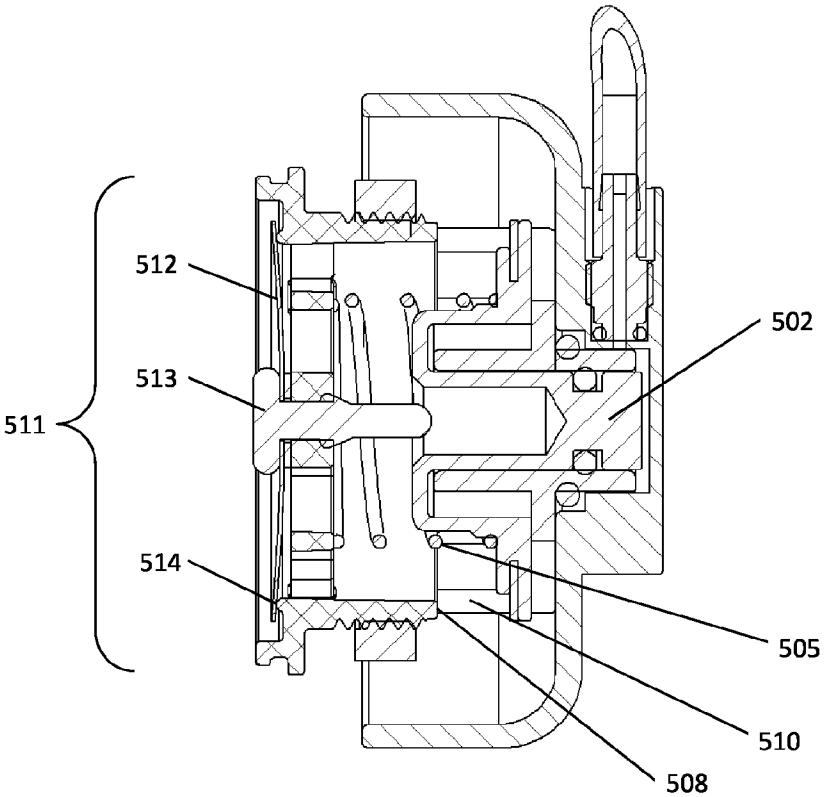

A connector (406) at the feed to the demand valve allows the same pressure that is feeding the demand valve to be fed via a tube (4*a*) to a combined inhalation and anti-suffocation valve (7) which is shown in more detail in FIGS. 5A and 5B. When pressure is present, the valve (7) is closed, so any gas inhaled by the user comes from the demand valve. When pressure is not present, the valve is open, allowing inhalation through an inhalation valve that opens in response to a pressure difference across it. When the demand valve is not pressurised, supplementary oxygen is delivered from the pulsed delivery unit (212), and the pressure to trigger an oxygen pulse is generated by the opening pressure of the inhalation valve.

A tube (5) to the connection manifold (5*a*) joins the mask to the pulse delivery unit (212), such that the pressure in the mask at the onset of inhalation is communicated to the pulse delivery unit and flow from the pulse delivery unit is delivered into the mask. The connection manifold inside the mask directs the oxygen to the region of the mouth and nose of the user, so that as much of the pulse of oxygen as possible is inhaled with the initial inhalation. A conformable tube, i.e. one that is able to be bent to a shape, which is then maintained, may be provided inside the mask, connected to the inside of the connection manifold (5*a*) to help achieve this for difference face shapes and sizes.

An exhalation valve (404) allows exhalation. If the demand valve delivers negative pressure (i.e. when breathing from the demand valve, there is never a pressure higher than ambient inside the mask during inhalation), the exhalation valve would have to have an opening threshold above the range of positive pressure encountered, so that the demand valve did not leak gas out of the exhalation valve. This is known, and normally achieved by a sprung valve, or a resilient flap valve, arranged to be deflected at the point it is closed. Typically a housing around the exhalation valve directs the exhaled gas downwards through a "snood", (405), which also helps to prevent icing of the exhalation valve in cold conditions, by shielding it from ambient air and protecting the heat transferred from the exhaled air. The direction downwards also helps to prevent misting of any goggles or visor the user may be wearing.

FIGS. 5A and 5B

FIG. 5B shows a possible embodiment of a combined inhalation and anti-suffocation valve according to the present invention that is closed when pressure to the demand valve (6) is present in the tube (4*a*).

A housing (501), which is on the atmosphere side of the mask (9), receives the pressure connection (4*a*) communicating pressure to a piston (502) with a seal (503) operating in a bore (504) that urges the piston against a closing spring (505) to a closed position, where a resilient sealing member (506), mounted on the outside of the piston (507), is held closed against a seat (508) of a second housing (509).

A gap in the second housing (509) seals to the mask.

FIG. 5A shows the mask in the open position, when the pressure to the demand valve supply is not present. The spring (505) urges the piston (502) away from the seat (508) creating an opening (510) though which the user may inhale.

An inhalation valve (511), consisting of a disc (512) of resilient material, fixed in the middle with a fastener (513), and arranged to be deformed against an inhalation valve seat (514) in the closed position, such that the pressure in the mask has to be a little lower or negative compared to the ambient pressure. The level of the negative pressure for opening the inhalation valve (511) is arranged to be at a level such that the pulse delivery unit (212 in FIG. 2B) triggers before the inhalation valve opens.

This allows the user to inhale the remainder of their inhalation from ambient atmosphere, thus providing a pulsed oxygen supplement.

Figure 6B:
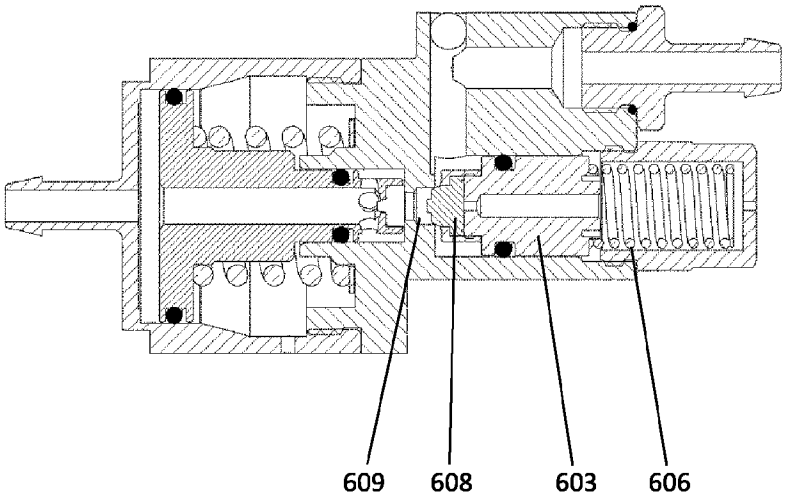
FIG. 6B shows the same in the closed position, when the supply pressure is below the threshold.
Figure 6A:
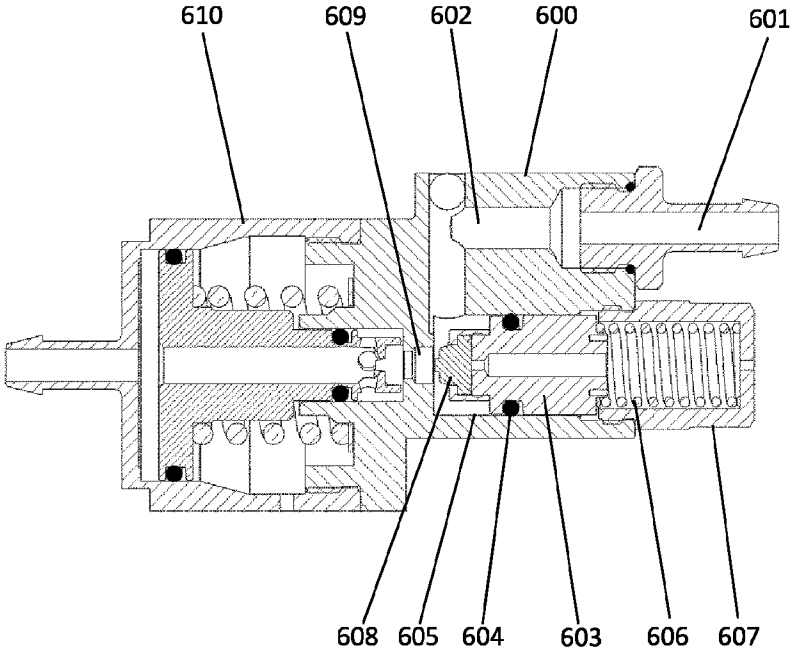
FIG. 6A shows a detail embodiment of a regulator and low pressure shut-off valve according to the present invention, in the open position.

FIGS. 6A and 6B

FIG. 6A shows a detail embodiment of a regulator and low pressure shut-off valve that may be used with the present invention, in the open position, when pressure from the aircraft oxygen supply is present at the correct level, typically 5 to 6 bar.

An inlet (601) in a housing (600) receives pressure from the hose (12 in FIG. 1) from the aircraft oxygen supply. A passage (602) transmits the gas to the inlet (609) of a regulator (610). A closing piston (603) with a seal (604) sealably sliding in a bore (605) in the housing (600). A closing spring (606) retained by a cover (607) is arranged to bias the piston to a closed position, where a seal (608) seal to the regulator inlet (609). Pressure in the passage (602) acts on the seal diameter of the piston, to urge the closing piston against the closing spring to an open position.

The regulator is a standard piston regulator which is well known, arranged to deliver a substantially constant pressure, typically 4 bar, which is about 1 bar, lower than that normally supplied by the aircraft oxygen supply.

When the pressure from the aircraft oxygen supply is in its normal range, the piston is held in an open position, and the regulator delivers normal 4 bar pressure to the hose (14 in FIG. 1).

FIG. 6B shows the same in the closed position, when the supply pressure is below the threshold for normal demand valve and pulse delivery operation.

As the supply pressure from the aircraft oxygen supply falls, the pressure becomes insufficient to hold the piston (603) open against the closing spring (606), and the closing piston moves to a closed position, in which the seal (608) closes the inlet to the regulator (609).

The aim of this arrangement is to ensure that as soon as the aircraft oxygen supply pressure drops below a level suitable for operation, the supply to the cylinder valve manifold is cut off. At this point the pistons in the valve manifold as described in FIGS. 3A to 3C, switch over completely immediately with no intermediate state.

It will be apparent to one skilled in the art that this embodiment of the invention provides an integration of 100% oxygen delivery via a demand valve and a pulsed oxygen delivery system in which a predetermined pulse of oxygen is delivered at the start of the inhalation cycle to supplement the oxygen in the ambient air. This alone leads to a remarkable improvement in the efficiency of oxygen delivery during a parachuting trip. In an alternative embodiment, the pulsed delivery system can be adapted to deliver a pulse of variable volume. The volume of oxygen in the pulse can be reduced as the parachutist descends, the pressure increases and the amount of oxygen drawn from the environment increases. This refinement represents, with increased conservation of oxygen, a still further improvement over the prior art.

SUMMARY

It will be clear to one skilled in the art that the present invention provides a means to provide supplementary oxygen to a parachutist in a way that uses the oxygen more efficiently than prior art, allowing for a smaller cylinder or longer duration or a combination of both.

It will also be clear that all the parts of the system lend themselves to be designed to give very clear "digital" function, in which there are no functions that rely on very precise characteristics.

The present invention provides a system that may be fully automatic in its operation, so that the user has merely to turn on the cylinder valve (203) and connect and disconnect the aircraft oxygen supply. All other changes happen automatically, so the user can concentrate on their other tasks, increasing safety and effectiveness.

The invention claimed is:

1. A supplementary oxygen system for variable-altitude use, the system comprising:

a valve manifold having an input cylinder port, a supply port, an input selection valve, first and second outputs and an output selection valve, the input selection valve being in fluid communication with an input to the output selection valve via a link passage;

a pulse gas delivery system in fluid communication with the second output and that is activatable to deliver a pulse of gas of predetermined duration; wherein the input cylinder port is connectable via a regulator to a pressure vessel containing compressed oxygen and the supply port is adapted to receive a connector from an external oxygen supply;

the input selection valve is switchable between a first position in which gas flow from the input cylinder port is directed towards the link passage and a second position in which gas flow from a supply port is directed towards the link passage; and the output selection valve is switchable between a first position in which gas flowing through the valve manifold is directed to the first output and a second position in which gas flowing through the valve manifold is directed to the second output and to the pulse gas delivery system.

2. The supplementary oxygen system in accordance with claim 1 that includes a mask, wherein the mask comprises:

a demand valve that is connectable to the first output of the valve manifold; an inhalation valve; a connection manifold that is connectable with an output of the pulse gas delivery system; an exhalation valve; and a piloting line that provides fluid communication between the inhalation valve and an input to the demand valve, wherein the inhalation valve is configured such that it is closed if a gas pressure above ambient is present in the piloting line and openable to allow ambient air to be drawn into the mask otherwise and the pulse gas delivery system is configured to be responsive to a drop in pressure inside the mask to deliver a pulse of oxygen.

3. The supplementary oxygen system in accordance with claim 2 wherein the inhalation valve is openable in response to the drop in pressure within the mask, and wherein the pressure drop required to initiate opening of the inhalation valve is a larger drop than that to which the pulse gas delivery system is responsive.

4. The supplemenraty oxygen system in accordance with claim 2 wherein the connection manifold is located at a position on the mask that, when fitted to a user, is in the vicinity of the user's nose and mouth.

5. The supplementary oxygen system in accordance with claim 1 that also includes a switching mechanism responsive to atmospheric pressure, wherein if the atmospheric pressure is below a threshold level then the output selection valve is in its first position and if the atmospheric pressure is above the threshold level then the output selection valve is in its second position.

6. The supplementary oxygen system in accordance with claim 1 wherein the system also includes an input selection valve switching mechanism responsive to gas pressure within the supply port.

7. The supplementary oxygen system in accordance with claim 6 wherein the input selection valve includes:

a fluid passageway that is moveable with a reaction member; and a biasing means arranged to urge the reaction member and fluid passageway to a configuration in which the input selection valve is in its first position in which gas flow from the input cylinder port is directed towards the link passage; and wherein the supply port and reaction member are arranged such that gas pressure arising from gas flowing into the input selection valve from the supply port urges the reaction member towards a configuration in which the input selection valve is in its second position in which gas flow from the supply port is directed towards the link passage.

8. The supplementary oxygen system in accordance with claim 7 wherein a control chamber is located adjacent to the reaction member and in fluid communication via a passage with the supply port and positioned such that the gas pressure within the control chamber counters the effect of the biasing means on the reaction member.

9. The supplementary oxygen system in accordance with claim 7 wherein:

the input selection valve reaction member is a spool piston configured to run in a bore that includes a series of spool seals between respective pairs of which are located openings leading to the input cylinder port and the link passageway;

the supply port opens into the bore at a location outside the seals, on a side in closer proximity to the link passageway; and the fluid passageway is formed by a narrowed region of the piston that cannot make contact with the seals.

10. The supplementary oxygen system in accordance with claim 8 wherein the biasing means is set such that it balances the gas pressure within the control chamber at a supply pressure threshold level.

11. The supplementary oxygen system in accordance with claim 1 wherein the system includes an inhibitor mechanism that is actuated by attachment of the connector to the supply port to prevent the output selection valve from being switchable to its second position.

12. The supplementary oxygen system in accordance with claim 1 for use with an oxygen aircraft supply line to which the connector is fitted, wherein the connector includes a check valve that is openable by way of connection of the connector to the supply port.

13. The supplementary oxygen system in accordance with claim 12 wherein the aircraft supply line also includes a minimum pressure shut-off valve that is arranged to cut off supply to the connector if gas pressure within the aircraft supply line falls below a threshold value and a regulator adapted to, if the shut-off valve is open, deliver gas at substantially constant pressure to the connector.

14. A supplementary oxygen system for variable-altitude use, the system comprising:

a valve manifold that is connectable via a regulator to a pressure vessel containing compressed oxygen, the valve manifold having first and second outputs and an output selection valve;

a pulse gas delivery system in fluid communication with the second output and that is activatable to deliver a pulse of gas of predetermined duration; and a switching mechanism responsive to atmospheric pressure, wherein if the atmospheric pressure is below a threshold level then the output selection valve is in a first position in which gas flowing through the manifold is directed to the first output and if atmospheric pressure is above the threshold level then the output selection valve is in a second position in which gas flowing through the manifold is directed to the second output and to the pulse gas delivery system.

15. The supplementary oxygen system in accordance with claim 14 wherein the output selection valve includes:

a fluid passageway that is moveable with a reaction member;

a biasing means arranged to urge the reaction member and fluid passageway to a configuration in which the output selection valve is in its second position the fluid flow through the fluid passageway is to the second output and pulse gas delivery system;

a control chamber adjacent to the reaction member and in fluid communication via a restricted passage with a gas source, in which a build up of gas pressure within the control chamber serves to urge the reaction member and the fluid passageway to a configuration in which the output selection valve is in its first position and fluid flow through the fluid passageway is to the first output;

and wherein the switching mechanism includes:

a pressure responsive element; and a switching valve seat whereby the switching valve seat us either open or closed in response to a state of the pressure responsive element such that when the switching valve seat is in its low-pressure configuration, gas is directed into the control chamber.

16. The supplementary oxygen system in accordance with claim 15 wherein the roles of the biasing means and the control chamber are reversed, that is, the biasing means urges the reaction member to a configuration in which the output selection valve is in its first position and fluid flow is to the first output and gas pressure within the control chamber serves to urge the reaction member to a configuration in which the output selection valve is in its second position and fluid flow is to the second output and pulse gas delivery system; and gas is directed into the control chamber when the switching valve seat is in its high-pressure configuration.

17. The supplementary oxygen system in accordance with claim 15 wherein the pressure responsive element is an aneroid which expands as the atmospheric pressure is reduced, and the switching valve seat is in its low-pressure configuration when closed, the aneroid being arranged such that, at or below the threshold level it is of a length sufficient to seal the switching valve seat.

18. The supplementary oxygen system in accordance with claim 15 wherein:

the valve manifold also includes an input selection valve that is in fluid communication with an input to the output selection valve via a link passage, the input selection valve being switchable between a first position in which gas flow from an input cylinder port that is connected to an output of the regulator is directed towards the link passage and a second position in which gas flow from a supply port is directed towards the link passage, the supply port being adapted to receive a connector from an external oxygen supply; and the output selection valve reaction member has an end face that is located in the vicinity of the supply port and the reaction member is configured such that, on attachment of the connector, a peripheral surface of the connector makes contact with the end face and prevents it moving into the position required for the output selection valve to direct fluid flow to the second output.

19. The supplementary oxygen system in accordance with claim 15 wherein the output selection valve reaction member is a spool piston configured to run in a bore that includes a series of spool seals (328, 329, 330, 331) between respective pairs of which are located openings leading to the first output, a link passageway and the second output and wherein the fluid passageway is formed by a narrowed region of the piston that cannot make contact with the seals.

20. The supplementary oxygen system in accordance with claim 14, wherein the output selection valve is a solenoid valve that is connected to an output of an atmospheric pressure sensor.

21. A supplementary oxygen system for variable-altitude use, the system comprising:

a valve manifold that is connectable via a regulator to a pressure vessel containing compressed oxygen, the valve manifold having first and second outputs and an output selection valve;

a pulse gas delivery system in fluid communication with the second output and that is activatable to deliver a pulse of gas of predetermined duration; and a pressure responsive element responsive to atmospheric pressure and a switching valve seat arranged such that the switching valve seat is either open or closed in response to a state of the pressure responsive element, wherein if atmospheric pressure is below a threshold level then the switching valve seat is in its low-pressure configuration and the output selection valve is in a first position in which gas flowing through the valve manifold is directed to the first output and if the atmospheric pressure is above the threshold level then the output selection valve is in a second position in which gas flowing through the manifold is directed to the second output and to the pulse gas delivery system.

* * * * *